United States Patent [19]

Martin

[11] 4,440,344

[45] Apr. 3, 1984

[54] FUEL INJECTOR

[75] Inventor: Barrie J. Martin, Shenfield, England

[73] Assignee: Eaton Corporation, Cleveland, Ohio

[21] Appl. No.: 400,352

[22] Filed: Jul. 21, 1982

Related U.S. Application Data

[63] Continuation of Ser. No. 179,536, Aug. 19, 1980, abandoned.

[30] Foreign Application Priority Data

Sep. 11, 1979 [GB] United Kingdom ..... 7931506

[51] Int. Cl.[3] ..... B05B 1/08

[52] U.S. Cl. ..... 239/102

[58] Field of Search ..... 239/102, 571; 261/81, 261/66

[56] References Cited

U.S. PATENT DOCUMENTS

| | | | |
|---|---|---|---|
| 3,297,255 | 1/1967 | Fortman | 239/102 |
| 4,013,223 | 3/1977 | Martin | 239/102 |
| 4,048,963 | 9/1977 | Cottell | 239/102 |
| 4,166,577 | 9/1979 | Elwell | 239/102 |

*Primary Examiner*—John J. Love

*Attorney, Agent, or Firm*—C. H. Grace; R. A. Johnston

[57] ABSTRACT

An injector for injecting fuel for an engine, which injector comprises a nozzle, a fuel injection orifice in a transverse face of the nozzle, a valve obturator for closing the orifice, a vibrator for vibrating the nozzle to cause the valve obturator to move away from the orifice to allow fuel to be injected, and a housing for the valve obturator, the housing: (A) being fixed in position, (B) having an open downstream end, and (C) being positioned adjacent the orifice but spaced apart from the transverse face of the nozzle by a distance which is not large enough to allow the obturator to escape through the space defined by the housing and the transverse face of the nozzle.

12 Claims, 2 Drawing Figures

FUEL INJECTOR

Figure 1:
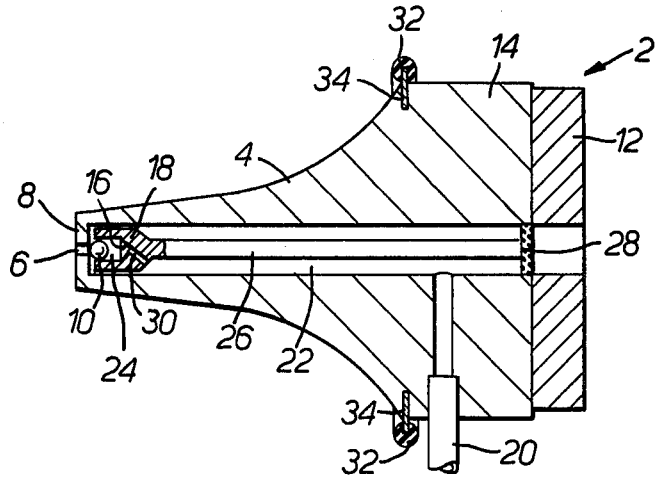

This is a continuation of application Ser. No. 179,536 filed Aug. 19, 1980 now abandoned.

This invention relates to an injector for injecting fuel for an engine.

Injectors for injecting fuel for an engine are known. One known injector comprises a nozzle, a fuel injection orifice in a transverse face of the nozzle, valve obturator means for closing the orifice, vibratory means for vibrating the nozzle to cause the valve obturator means to move away from the orifice to allow fuel to be injected, and a housing for the valve obturator means. This housing is fixed in position against the transverse face of the nozzle. The end of the housing adjacent the transverse face of the nozzle is provided with a plurality of slots for enabling fuel to pass over the housing and into its interior.

It has now been discovered that it is advantageous to increase the number of slots in the housing to enable improved fuel access to the housing. It has further been discovered that it is not possible to continue increasing the number of slots in the housing because the housing is a relatively small item and the parts of the housing between the slots tend to break off if too many slots are provided. The small size of the housing thus tends to place a constraint on the number of slots that can be provided. It is an aim of the present invention to provide an alternative arrangement which does not suffer from this problem.

Accordingly, this invention provides an injector for injecting fuel for an engine, which injector comprises a nozzle, a fuel injection orifice in a transverse face of the nozzle, valve obturator means for closing the orifice, vibratory means for vibrating the nozzle to cause the valve obturator means to move away from the orifice to allow fuel to be injected, and a housing for the valve obturator means, the housing (A) being fixed in position, (B) having an open downstream end, and (C) being positioned adjacent the orifice but spaced apart from the transverse face of the nozzle by a distance which is not large enough to allow the valve obturator means to escape through the space defined by the housing and the transverse face of the nozzle.

By spacing the housing away from the transverse face of the nozzle, fuel can pass over the entire surface of the housing, over the entire end of the housing adjacent the transverse face of the nozzle and into the interior of the housing.

Preferably, the housing is provided with an aperture at a position to which the valve obturator means tends to travel when it is vibrated away from the orifice, the aperture enabling fuel to pass therethrough and force the valve obturator means back to the orifice when the vibratory means ceases to vibrate the nozzle.

Advantageously, the housing is supported on an elongate member.

The elongate member is preferably secured at the end of the injector remote from the orifice. This end of the injector when the injector is vibrated is considerably less sensitive than the end of the injector having the orifice. The elongate member, for example a rod, can thus be welded, brazed or otherwise secured in position and the securing means will not unduly affect the operation of the injector. If the securing means were to be positioned near the end of the injector containing the orifice, the securing means could disadvantageously affect the vibratory characteristics of the injector.

The outside of the housing may be provided with flutes for positioning the housing centrally in the fuel passageway but allowing the fuel to pass over the housing. These flutes may be straight or spiraled. When the flutes are spiraled, they induce swirl in the fuel.

Preferably, the valve obturator means is a ball.

Preferably, the vibratory means is a piezoelectric device although it will be appreciated that a magnetostrictive device could also be employed if desired.

The present invention also extends to a fuel injection system including an injector in accordance with the invention.

Figure 2:
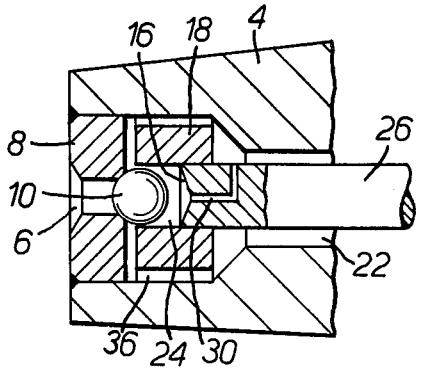

Embodiments of the invention will now be described solely by way of example and with reference to the accompanying drawings in which:

FIG. 1 is a cross section through a first injector in accordance with the invention; and FIG. 2 is an enlarged cross section through a tip part of another injector in accordance with the invention.

Referring to FIG. 1, there is shown an injector 2 for injecting fuel for an engine (not shown). The injector 2 comprises a nozzle 4 having a fuel injection orifice 6 in a transverse face 8 of the nozzle 4. Valve obturator means in the form of a ball 10 is provided for closing the orifice 6.

Vibratory means in the form of a piezoelectric crystal device 12 is positioned on a body part 14 of the injector 2. When the device 12 is electrically activated, the transverse face 8 of the nozzle 4 is caused to vibrate and this moves the ball 10 away from the orifice 6. The ball 10 tends to travel to the right as shown in FIG. 1 until it engages an end face 16 of a housing 18.

As shown in FIG, 1, the housing 18 has an open downstream end which is positioned adjacent the orifice 6 but spaced apart from the transverse face 8 of the nozzle 4. Fuel passing along a fuel pipe 20 can thus pass into the longitudinal passage 22, over the entire outside of the housing 18, over the entire end of the housing 18 and into the inside 24 of the housing 18.

The housing 18 is joined to an elongate member in the form of a rod 26 which is brazed at position 28 to the body part 14 of the injector 2.

When the injector 2 is vibrated, the ball 10 will tend to move towards the face 16 inside the housing 18. In order to cause the ball 10 to quickly return to the orifice 6 when electrical signals cease to be passed to the device 12, the rear portion of the housing 18 is provided with an aperture 30.

Fuel passing along the passage 22 will pass through the aperture 30 and will be effective to force the ball 10 towards the orifice 6 to close the orifice 6 and thus quickly shut off the fuel being injected through the orifice 6 when the device 12 is not being activated.

The injector 2 can be mounted in an air duct leading to an engine by means of an O-ring seal 32 which is mounted on a flange 34. The seal 32 prevents too much of the vibratory energy of the nozzle 2 being lost to the surrounding mounting arrangement (not shown) for the nozzle 2.

Referring now to FIG. 2, similar parts as in FIG. 1 have been given the same reference numeral and their precise construction and operation will not again be given. In FIG. 2, the housing 18 is joined to the end of the rod 26 and the end of the rod 26 is effective to form the rear face 16 of the housing 18. The aperture 30 for the face 16 is formed as a right angle aperture as shown in the end of the rod 26. The outside of the housing 18 is provided with flutes 36 for enabling fuel to pass along the passage 22 and over the housing 18.

It is to be appreciated that the embodiments of the invention described above with reference to the accompanying drawings have been given by way of example only and that modifications may be effected.

I claim:

1. An injector for injecting fuel for an engine, which injector comprises a nozzle, a fuel injection orifice in a transverse face of the nozzle, a fuel passage formed in said nozzle communicating with said fuel injection orifice, valve obturator means for closing the orifice, vibratory means for vibrating the nozzle to cause the valve obturator means to move away from the orifice to allow fuel to be injected, and a housing for the valve obturator means, the housing: (A) being fixed in position and secured to the nozzle at the end remote from the orifice (B) having an open downstream end with an opening formed therein, and (c) being positioned adjacent the orifice but with said downstream end spaced apart from the transverse face of the nozzle.

2. An injector according to claim 1 in which the housing is provided with an aperture at a position to which the valve obturator means tends to travel when it is vibrated away from the orifice, the aperture enabling fuel to pass therethrough and force the valve obturator means back to the orifice when the vibratory means ceases to vibrate the nozzle.

3. An injector according to claim 1 in which the housing is supported on an elongate member.

4. An injector according to claim 1 in which the outside of the housing is provided with flutes for positioning the housing centrally in the fuel passage but allowing the fuel to pass over the housing.

5. An injector according to claim 1 in which the valve obturator means is a ball.

6. An injector according to claim 1 in which the vibratory means is a piezoelectric device.

7. A fuel injection system comprising a nozzle for injecting fuel into an engine; means for mounting said nozzle in an air duct leading to the engine; a fuel injection orifice in a transverse face of the nozzle; a fuel passage formed in said nozzle for communicating said fuel injection orifice with a source of fuel to be injected; valve obturator means for closing the orifice; vibratory means for vibrating the nozzle to cause the valve obturator means to move away from the orifice to allow fuel to be injected; a housing for the valve obturator means, the housing having an end face with an opening formed therein and said fuel passage, with said end face spaced from the transverse face of the said housing nozzle mounting means including means secured to said nozzle at the end remote from said orifice, wherein fuel flowing through the fuel passage reaches the fuel injection orifice by flowing past the side walls of said housing and through the space between said end face and said transverse face, the space being small enough to prevent passage of said valve obturator means through said space.

8. A fuel injection system according to claim 7, wherein said means for mounting comprises a rod extending through said fuel passage and having one end connected to said vibrating means and one end connected to said housing.

9. An injector for injecting fuel comprising:

a nozzle having a fuel passage formed therein;

a fuel injection orifice formed in a transverse face of the nozzle and communicating with said fuel passage;

valve obturator means for closing said orifice; vibratory means for vibrating said nozzle so as to move said valve obturator means away from said orifice;

a housing having walls defining an interior space for receiving said valve obturator means, an end face with an opening formed therein for passage of said valve obturator means, and a passage extending through one of said walls for introducing fuel from said fuel passage into the interior of said housing so that the fuel urges said valve obturator means towards said orifice; and means for mounting said housing in said fuel passage so that said end face is spaced from said transverse face said housing mounting means including means secured to said nozzle at the end thereof remote from said orifice whereby a fuel flow path is defined extending past the walls of said housing, through the space between said end face and said transverse face to said fuel injection orifice; the size of said space being less than the size of said valve obturator means so as to prevent passage of said valve obturator means through said space.

10. An injector according to claim 9, in which the surface of the downstream end of said housing is an uninterrupted planar surface.

11. An injector according to claim 3, wherein the aperture has an axis skewed to an axis of the elongate member.

12. An ultrasonic injector assembly comprising:

(a) a nozzle body having an injection orifice formed in a transverse face of one end thereof;

(b) a fuel passage formed in said body and communicating with said orifice, said passage adapted for connection to a source of liquid to be injected;

(c) valve means moveable with respect to said body for opening and closing said orifice;

(d) means operable upon excitation for vibrating said nozzle body for causing the valve means to move away from the orifice for permiting said liquid to be injected; and, (e) means defining a housing for said valve means fixed within said nozzle body passage and having a downstream end and with an opening formed therein and disposed adjacent said orifice and spaced from said transverse face, said housing defining means having an opposite end thereof securred to said nozzle body at a nodal region remote from said orifice, wherein upon vibration of the nozzle, the orifice end of the nozzle body has an amplitude greater than the adjacent downstream end of said housing defining means.

* * * * *